US011130926B2

(12) United States Patent
Kamei et al.

(10) Patent No.: US 11,130,926 B2
(45) Date of Patent: Sep. 28, 2021

(54) LUBRICATING OIL COMPOSITION FOR AUTOMATIC TRANSMISSIONS

(71) Applicant: SHELL OIL COMPANY, Houston, TX (US)

(72) Inventors: Genki Kamei, Tokyo (JP); Ryuji Maruyama, Kanagawa (JP)

(73) Assignee: SHELL OIL COMPANY, Houston, TX (US)

( * ) Notice: Subject to any disclaimer, the term of this patent is extended or adjusted under 35 U.S.C. 154(b) by 263 days.

(21) Appl. No.: 16/066,076

(22) PCT Filed: Dec. 27, 2016

(86) PCT No.: PCT/EP2016/082722
§ 371 (c)(1),
(2) Date: Jun. 26, 2018

(87) PCT Pub. No.: WO2017/114838
PCT Pub. Date: Jul. 6, 2017

(65) Prior Publication Data

US 2020/0263105 A1 Aug. 20, 2020

(30) Foreign Application Priority Data

Dec. 28, 2015 (JP) ..... JP2015-256137

(51) Int. Cl.

| | |
|---|---|
| ***C10M 173/02*** | (2006.01) |
| ***C10M 135/30*** | (2006.01) |
| ***C10M 169/04*** | (2006.01) |
| ***C10M 105/32*** | (2006.01) |
| ***C10M 107/02*** | (2006.01) |
| ***C10M 145/14*** | (2006.01) |
| *C10N 30/00* | (2006.01) |
| *C10N 40/04* | (2006.01) |
| *C10N 30/02* | (2006.01) |

(52) U.S. Cl.
CPC ..... *C10M 169/041* (2013.01); *C10M 105/32* (2013.01); *C10M 107/02* (2013.01); *C10M 145/14* (2013.01); *C10M 2205/0206* (2013.01); *C10M 2205/0225* (2013.01); *C10M 2205/173* (2013.01); *C10M 2207/2805* (2013.01); *C10M 2209/084* (2013.01); *C10M 2290/00* (2013.01); *C10N 2030/02* (2013.01); *C10N 2030/68* (2020.05); *C10N 2030/74* (2020.05); *C10N 2040/042* (2020.05)

(58) Field of Classification Search
CPC ..... C10M 169/041; C10M 145/14; C10M 107/02; C10M 105/32; C10M 2205/0206; C10M 2205/0225; C10M 2205/173; C10M 2209/084; C10M 2290/00; C10M 2207/2805; C10N 2030/74; C10N 2030/02; C10N 2030/68; C10N 2040/042
USPC ..... 508/507, 572
See application file for complete search history.

(56) References Cited

U.S. PATENT DOCUMENTS

| | | | | |
|---|---|---|---|---|
| 8,425,678 | B2 | 4/2013 | Quinn et al. | |
| 2004/0132629 | A1 | 7/2004 | Vinci et al. | |
| 2005/0133407 | A1* | 6/2005 | Abernathy | C10M 177/00 208/18 |
| 2010/0087349 | A1* | 4/2010 | Lee | C10M 111/04 508/499 |
| 2015/0166927 | A1 | 6/2015 | Tamoto et al. | |
| 2016/0194578 | A1* | 7/2016 | Sakanoue | C10M 105/04 508/473 |

FOREIGN PATENT DOCUMENTS

| | | | |
|---|---|---|---|
| CN | 1270180 | A | 10/2000 |
| CN | 101065469 | A | 10/2007 |
| CN | 101495607 | A | 7/2009 |
| CN | 105112139 | A | 12/2015 |
| EP | 2186871 | A1 | 5/2010 |
| JP | 2009096925 | A | 5/2009 |
| RU | 2080356 | C1 | 5/1997 |
| WO | 02083825 | A1 | 10/2002 |
| WO | 2013182565 | A1 | 12/2013 |

OTHER PUBLICATIONS

"Plastics—Determination of average molecular mass and molecular mass distribution of polymers using size-exclusion chromatography—Part 1: General principles", ISO 16014-1, 1st Ed., Mar. 15, 2003, 8 pages.

International Search Report and Written Opinion received for PCT Patent Application No. PCT/EP2016/082722, dated Jul. 4, 2017, 10 pages.

* cited by examiner

*Primary Examiner* — Prem C Singh
*Assistant Examiner* — Francis C Campanell
(74) *Attorney, Agent, or Firm* — Shell Oil Company

(57) ABSTRACT

The present invention provides a lubricating oil composition for automatic transmissions which comprises: 55 to 85 mass % of a Fischer-Tropsch synthetic oil with a kinematic viscosity at 100° C. of 2 to 4 mm2/s as a low-viscosity base oil; 1 to 10 mass % of an olefin copolymer 5 with a kinematic viscosity at 100° C. of 150 to 1,000 mm2/s as a high-viscosity base oil; and a polymethacrylate with a weight-average molecular weight of 10,000 to 50,000. This lubricating oil composition is such that the viscosity index of the composition is not 10 less than 190, the Brookfield viscosity is not more than 6,000 mPa·s at low temperature (−40° C.), the kinematic viscosity at 100° C. is 6 to 7 mm2/s, and the rate of reduction of the kinematic viscosity after a KRL shear stability test (60° C., 20 hr) is kept to within not more 15 than 3%.

5 Claims, No Drawings

LUBRICATING OIL COMPOSITION FOR AUTOMATIC TRANSMISSIONS

Cross reference to related applications

This is a national stage application of International Application No. PCT/EP2016/082722, filed 27 Dec. 2016, which claims benefit of priority to Japanese Patent Application No. 2015-256137, filed 28 Dec. 2015.

FIELD OF THE INVENTION

This invention relates to a lubricating oil composition suitable for use in automatic transmissions.

BACKGROUND OF THE INVENTION

Lubricating oils, and in particular automatic transmission fluids, are used in automatic transmissions, including torque converters, wet clutches, gear bearing mechanisms and hydraulic mechanisms, but in order to actuate these automatic transmissions smoothly, it is a requirement to ensure that various functions such as the power transmission medium, lubrication of gears, heat transmission medium and maintenance of fixed friction characteristics are all kept in good balance.

In such automatic transmissions, it is necessary to modify the viscosity of the lubricating oil and to modify friction so as to ensure that shocks during gear changes are reduced as well as reducing energy losses.

To modify a lubricating oil in this way, modifications to the viscosity of an overall composition can be made by using a mineral oil of relatively low viscosity as a base oil and using a polymethacrylate in this a viscosity index improver as described in Japanese Laid-open Patent 2009-96925.

The inventors have endeavoured to establish that it is possible to make an automatic-transmission lubricating oil composition in which the viscosity index at low viscosity is high, viscosity characteristics at low temperatures are excellent and shear stability is good, and also evaporation at high temperatures is low, so that it can be used satisfactorily at all times in the same state, and also that it is possible to improve fuel consumption performance.

SUMMARY OF THE INVENTION

This invention provides a lubricating oil composition for automatic transmissions which comprises: 55 to 85 mass % of a Fischer-Tropsch synthetic oil with a kinematic viscosity of 2 to 4 $mm^2/s$ at 100° C. as a low-viscosity base oil; 1 to 10 mass % of an olefin copolymer with a kinematic viscosity of 150 to 1000 $mm^2/s$ at 100° C. as a high-viscosity base oil; and a polymethacrylate with a weight-average molecular weight of 10,000 to 50,000; such that the viscosity index of the composition is not less than 190, the Brookfield viscosity is not more than 6000 mPa·s at low temperature (−40° C.), the kinematic viscosity at 100° C. is 6 to 7 $mm^2/s$, and the rate of reduction of the kinematic viscosity after a KRL shear stability test (60° C., 20 hours) is kept to within not more than 3%.

DETAILED DESCRIPTION OF THE INVENTION

The lubricating oil composition of this invention has a high viscosity index at low viscosity, and the viscosity characteristics at low temperatures are excellent, and shear stability is good. Also, evaporation at high temperatures is low and it is possible to achieve a composition with outstandingly good oxidative stability while maintaining the friction characteristics. Even at high-temperature oxidation, changes in viscosity and viscosity index are within a small range of fluctuation, and the various functions such as the power transmission medium, lubrication of gears, heat transmission medium and maintenance of fixed friction characteristics are kept in good balance. It is therefore possible to use it for long periods always in the same state, and it is possible to make good use of it use it to improve fuel consumption.

This lubricant composition can also be used effectively over a wide range of industrial lubricating oils such as automobile gear oils, transmission oils such AT oils, MT oils and CVT oils, hydraulic oils and compressor oils.

GTL (gas-to-liquid) base oils synthesised by the Fischer-Tropsch process in the technology of turning natural gas into liquid fuels are used for the aforementioned low-viscosity base oils, and these GTL base oils are ideal for use as base oils in this invention, being, relative to mineral oil base oils produced from crude oil, extremely low in sulphur content and aromatics content, and having a very high paraffin constituent ratio, which means that they have superior oxidative stability and extremely small evaporation losses.

A wide range of kinematic viscosities at 100° C. exist for these GTLs, but those with 2 to 4 $mm^2/s$ are to be used. Also, the total sulphur content is typically below 1 ppm, and the total nitrogen content is below 1 ppm, too. One example of such GTL base oil products is Shell XHVI (trade name).

It is best if the amount of these GTL base oils in the total composition is 55 to 85 mass %. If they are below 55 mass %, problems will occur to do with low volatility, low-temperature flow characteristics and shear stability, and so the desired effect may not be achieved.

In recent years, there have been cases of using low-viscosity poly-α-olefins with kinematic viscosities at 100° C. of the order of 2 $mm^2/s$ with the aim of improving low-temperature flow characteristics, but there are problems to do with market distribution and high price, and so it is possible to use the aforementioned GTL base oils advantageously also from these points of view.

An olefin copolymer is used as the aforementioned high viscosity base oil. This olefin copolymer is specifically an ethylene-α-olefin or the like, and those used will have a 100° C. kinematic viscosity of 150 to 1,000 $mm^2/s$.

Provided this 100° C. kinematic viscosity is not less than 150 $mm^2/s$, the effect of improving the viscosity index of the lubricating oil composition obtained can be displayed, and at the same time if it is not more than 1,000 $mm^2/s$, the shear stability of the lubricating oil composition obtained will be good.

From the standpoint of contributing a good viscosity improvement effect and shear stability, the 100° C. kinematic viscosity is preferably 300 to 800 $mm^2/s$, and if used in the proportion of 1 to 10 mass % in terms of the total composition the olefin copolymer can impart to the composition a viscosity suitable for high temperature use. If this amount is below the aforementioned limit, the effect in improving the viscosity index is liable to be insufficient, and on the other hand if it exceeds the aforementioned upper limit, the viscosity during low temperatures will increase and there will be a risk of inferior practical use.

The composition of this invention incorporates a polymethacrylate, and the weight-average molecular weight of this polymethacrylate (also referred to below as PMA)

may be of the order of 10,000 to 50,000, but is more preferably of the order of 15,000 to 30,000.

The weight-average molecular weight is preferably from 10,000 up to 40,000, but a weight-average molecular weight of from 10,000 up to 30,000 is more preferable, and a weight-average molecular weight of from 15,000 up to 30,000 is even more preferable.

Such polymethacrylates are incorporated in the range of 8 mass % to 12 mass %.

If the weight-average molecular weight is smaller than 10,000, the viscosity index will reduce, and if it is greater than 50,000, problems such as a reduction in shear stability may occur.

If the aforementioned blended amount is smaller than 8 mass % in terms of the total amount of the composition, the high-temperature viscosity of the composition will decrease and there will be a risk that wear of mechanical parts when using with stepless transmissions will increase. Also, if the blended amount exceeds 12 mass %, the viscosity of the lubricating oil composition will increase and there may be problems when using it with stepless transmissions, in the form of increased friction losses.

Accordingly, the amount of the aforementioned additive in the blend should be 8% to 12% but preferably 8.5% to 11.5% and more preferably 9% to 11%.

For this lubricating oil composition the viscosity index has to be not less than 190. If it is lower than this, the viscosity at low temperatures will become high and churning resistance will increase, and at high temperatures it will be difficult to maintain an oil film, so that there will be a greater possibility of wear increasing.

Also, the Brookfield viscosity at the low temperature of −40° C. must be not more than 6,000 mPa·s. If it is higher than this, startability in cold regions will worsen.

The kinematic viscosity at 100° C. must be 6 to 7 $mm^2/s$. If it is a lower viscosity than this, the maintenance of oil films at high temperatures will become difficult, whereas if it is a higher viscosity than this, the churning resistance will increase, which will have an impact on fuel economy.

In addition, in a KRL shear stability test measuring under conditions of 60° C. and 20 hours, the rate of reduction of the 100° C. kinematic viscosity after the test must be not more than 3%. If the shear stability is poor, the viscosity reduction of the composition becomes large and this has an impact on oil film retention at high temperatures.

It is possible to add an ester base oil to this lubricating oil composition. In recent years, as a means of improving high viscosity indexes, high-temperature oxidative stability and low-temperature flow characteristics, there has been a demand for base oils of API categories Group 2, Group 3 and Group 4, with a focus on highly refined base oils, and as a result of weaker polarities, the solubility of highly polar additives as transmission oils has become problematical. The aforementioned GTL base oils are classified as Group 3 and the olefin copolymers as Group 4.

In order to alleviate this, it is desirable to add an ester base oil to the composition, but ester base oils by their nature accelerate the swelling of seals in particular, and so if added in too large an amount will cause seals to swell, soften and burst. It is necessary to be aware that major problems may arise if the lubricating oil composition leaks from the transmission.

The instances of the aforementioned ester base oils that can be used must have a kinematic viscosity at 100° C. of 2 to 10 $mm^2/s$, but preferably not less than 2.5 $mm^2/s$. Also, its upper limit value is preferably not more than 8 $mm^2/s$, and more preferably not more than 6 $mm^2/s$, yet more preferably not more than 5 $mm^2/s$, and most preferably not more than 3.5 $mm^2/s$.

If the 100° C. kinematic viscosity of the ester base oil exceeds 10 $mm^2/s$, the viscosity/temperature characteristics and low-temperature flow characteristics will deteriorate, and if the 100° C. kinematic viscosity is below 2 $mm^2/s$, the evaporation losses of the lubricating oil base oil may become undesirably significant.

The aforementioned ester base oil may be any of monoesters, diesters and partial or total esters of polyhydric alcohols.

The alcohols forming the ester base oils may be monohydric alcohols, or any of the polyhydric alcohols, and the acids may be monobasic acids or polybasic acids.

The monohydric alcohols may be alcohols of carbon number 1 to 24, but preferably 1 to 12 and more preferably 1 to 8, and may be straight-chain or branched. They may also be saturated or unsaturated.

As examples of the alcohols of carbon number 1 to 24, mention may be made of methanol and ethanol, and straight-chain or branched propanol, butanol, pentanol, hexanol, heptanol, octanol, nonanol, decanol, undecanol, dodecanol, tridecanol, tetradecanol, pentadecanol, hexadecanol, heptadecanol, octadecanol, nonadecanol, eicosanol, heneicosanol, docosanol, tricosanol, tetracosanol, and mixtures thereof.

The polyhydric alcohols may be dihydric to decahydric alcohols, but preferably dihydric to hexahydric. Examples of dihydric to decahydric polyhydric alcohols include dihydric alcohols such as ethylene glycol, diethylene glycol, polyethylene glycol (3~15-mers of ethylene glycol), propylene glycol, dipropylene glycol, polypropylene glycol (3~15-mers of propylene glycol), 1,3-propanediol, 1,2-propanediol, 1,3-butanediol, 1,4-butanediol, 2-methyl-1,2-propanediol, 2-methyl-1,3-propanediol, 1,2-pentanediol, 1,3-pentanediol, 1,4-pentanediol, 1,5-pentanediol and neopentyl glycol.

There are also polyhydric alcohols such as glycerol, polyglycerol (2~8-mers of glycerol), trimethylolalkanes (trimethylolethane, trimethylolpropane, trimethylolbutane and so on), and 2~8-mers thereof, pentaerythritol and 2~4-mers thereof, 1,2,4-butanetriol, 1,3,5-pentanetriol, 1,2,6-hexanetriol, 1,2,3,4-butanetetrol, sorbitol, sorbitan, sorbitol-glycerol condensates, adonitol, arabitol, xylitol and mannitol.

There are also saccharides such as xylose, arabinose, ribose, rhamnose, glucose, fructose, galactose, mannose, sorbose, cellobiose, maltose, isomaltose, trehalose and sucrose. Mixtures of the aforementioned polyhydric alcohols may also be mentioned.

Of the aforementioned polyhydric alcohols, those preferred are dihydric to hexahydric alcohols such as diethylene glycol, polyethylene glycol (3~10-mers of ethylene glycol), propylene glycol, dipropylene glycol, polypropylene glycol (3~10-mers of propylene glycol), 1,3-propanediol, 2-methyl-1,2-propanediol, 2-methyl-1,3-propanediol, neopentyl glycol, glycerol, diglycerol, triglycerol, trimethylolalkanes (trimethylolethane, trimethylolpropane, trimethylolbutane and so on), and 2~4-mers thereof, pentaerythritol, dipenterythritol, 1,2,4-butanetriol, 1,3,5-pentanetriol, 1,2,6-hexanetriol, 1,2,3,4-butanetetrol, sorbitol, sorbitan, sorbitol-glycerol condensates, adonitol, arabitol, xylitol and mannitol, and mixtures thereof.

More preferred are ethylene glycol, propylene glycol, neopentyl glycol, glycerol, trimethylolethane, trimethylolpropane, pentaerythritol and sorbitan, and mixtures thereof.

As examples of yet more preferred instances, mention may be made of neopentyl glycol, trimethylolethane, trimethylolpropane and pentaerythritol, and mixtures thereof; by means of these even higher thermal and oxidative stability can be achieved.

For the acids forming the ester base oils, the monobasic acids include fatty acids of 2 to 24 carbons, and they may be straight-chain or branched, and saturated or unsaturated.

For example, the saturated fatty acids include acetic acid and propionic acid, and straight-chain or branched butanoic, pentanoic, hexanoic, heptanoic, octanoic, nonanoic, decanoic, undecanoic, dodecanoic, tridecanoic, tetradecanoic, pentadecanoic, hexadecanoic, octadecanoic, hydroxyoctadecanoic, nonadecanoic, eicosanoic, heneicosanoic, docosanoic, tricosanoic and tetracosanoic acids.

The unsaturated fatty acids include acrylic acid and straight-chain or branched butenoic, pentenoic, hexenoic, heptenoic, octenoic, nonenoic, decenoic, undecenoic, dodecenoic, tridecenoic, tetradecenoic, pentadecenoic, hexadecenoic, octadecenoic, hydroxyoctadecenoic, nonadecenoic, eicosenoic, heneicosenoic, docosenoic, tricosenoic and tetracosenoic acids. Mixtures of the aforementioned acids may also be mentioned.

Of the aforementioned saturated fatty acids and unsaturated fatty acids, these preferred are saturated fatty acids of carbon number 3 to 20, unsaturated fatty acids of carbon number 3 to 22, and mixtures thereof, but saturated fatty acids of carbon number 4 to 18, unsaturated fatty acids of carbon number 4 to 18, and mixtures thereof, are more preferred. Lubricity and handling qualities are enhanced, and if consideration is also given to oxidative stability, saturated fatty acids of carbon number 4 to 18 are most preferred.

As examples of the polybasic acids mention may be made of dibasic acids of carbon number 2 to 16 and trimellitic acid. The dibasic acids of carbon number 2 to 16 may be straight-chain or branched and they may also be saturated or unsaturated. They include, for example, ethanedioic acid and propanedioic acid, and straight-chain or branched butanedioic, pentandioic, hexanedioic, heptanedioic, octanedioic, nonanedioic, decanedioic, undecanedioic, dodecanedioic, tridecanedioic, tetradecanedioic, pentadecanedioic and hexadecanedioic acids. Mixtures thereof may also be mentioned.

The combinations of the aforementioned alcohols and aforementioned acids can be freely chosen; there are no special restrictions.

The amount of the aforementioned ester base oil added relative to the total amount of the composition is 1 to 20 mass %, but is preferably 2 to 10 mass % and most preferably 3 to 5 mass %. If the added amount exceeds 20 mass %, there will be impacts such as swelling or softening changes in seal materials.

Where necessary, various additives known in the art may be blended singly or in combinations of several kinds with the lubricating oil for automatic transmissions of this invention, for example extreme pressure additives, dispersants, metallic detergents, friction modifiers, anti-oxidants, corrosion inhibitors, rust preventatives, demulsifiers, metal deactivators, pour point depressants, seal swelling agents, defoamers and colourants.

Normally, in this case, it is common to use commercially available additives packages for automatic transmissions.

The lubricating oil composition for automatic transmissions of this invention is explained in more detail below by means of examples of embodiment and comparative examples, but the invention is in no way limited by these.

EXAMPLES

The following materials were prepared in order to make the examples of embodiment and comparative examples.

(1) Base Oils

{A} Low-Viscosity Base Oils

A-1: GTL (gas-to-liquid) base oil (characteristics: 40° C. kinematic viscosity 9.891 $mm^2/s$, 100° C. kinematic viscosity 2.705 $mm^2/s$)

A-2: Mineral oil (characteristics: 40° C. kinematic viscosity 10.00 $mm^2/s$, 100° C. kinematic viscosity 2.692 $mm^2/s$) (to make the 100° C. kinematic viscosity 2.7 "Ultra S-2" made by S-Oil and "Yubase 3" made by SK Lubricants were mixed in the proportions 42:58).

A-3: PAO (poly-α-olefin) (characteristics: 40° C. kinematic viscosity 9.915 $mm^2/s$, 100° C. kinematic viscosity 2.697 $mm^2/s$) (to make the 100° C. kinematic viscosity 2.7 "Durasyn 162" made by INEOS and "SpectraSyn4 PAO Fluid" made by ExxonMobil Chemical were mixed in the proportions 45:55).

{B} High-Viscosity Base Oils

B-1: Ethylene-α-olefin copolymer (characteristics: 100° C. kinematic viscosity 40 $mm^2/s$) ("Lucant HC40" made by Mitsui Chemicals)

B-2: Ethylene-α-olefin copolymer (characteristics: 100° C. kinematic viscosity 600 $mm^2/s$) ("Lucant HC600" made by Mitsui Chemicals)

B-3: Ethylene-α-olefin copolymer (characteristics: 100° C. kinematic viscosity 2,000 $mm^2/s$) ("Lucant HC2000" made by Mitsui Chemicals)

{C} Ester Base Oils

C-1: Ester base oil (characteristics: 40° C. kinematic viscosity 10.81 $mm^2/s$, 100° C. kinematic viscosity 3.051 $mm^2/s$) (ester base oil with diisnonyl adipate as the main constituent)

C-2: Ester base oil (characteristics: 40° C. kinematic viscosity 19.83 $mm^2/s$, 100° C. kinematic viscosity 4.447 $mm^2/s$) (ester base oil with an ester comprised of a mixture of caprylic acid (C8) and capric acid (C10) and trimethylolpropane as the main constituent)

(2) Additives

{D} Viscosity Index Improvers

D-1: Polymethacrylate (characteristics: weight-average molecular weight 5,200), polymer concentration 100%

D-2: Solution of polymethacrylate (characteristics: weight-average molecular weight 16,000) in mineral oil. After measuring using GPC, the ratio of the peak area of the polymer component and the peak area of the base oil was 69:31. The GPC measuring conditions were as given below.

The mass-average molecular weight was calculated by using JIS K7252-1 "Plastics—Determination of average molecular mass and molecular mass distribution of polymers using size-exclusion chromatography, Part 1: General principles".

Apparatus used: Shodex GPC-101
Detector: differential refractometer detector (RI)
Columns: KF-G (Shodex)×1, KF-805L (Shodex)×2
Measuring temperature: 40° C.
Carrier solvent: THF
Carrier flow rate: 0.8 ml/min (ref 0.3 ml/min)
Standard substances: Shodex Standard (polystyrene)
$Mp=2.0\times10^3$
$Mp=5.0\times10^3$
$Mp=1.01\times10^4$
$Mp=2.95\times10^4$
$Mp=9.60\times10^4$
$Mp=2.05\times10^5$ Calibration curves: three-dimensional Sample concentration: approx. 2 mass %

Amount of sample injected: 50 μL

The fraction which made a peak at about 17 minutes for the retention time was the polymer constituent and the fraction making a peak at about 22 minutes was the base oil component.

D-3: Solution of polymethacrylate in mineral oil (characteristics: weight-average molecular weight 85,000). Similarly, the ratio of the peak area of the polymer component and the peak area of the base oil in GPC was 36:64.

{E} Commercial ATF Additives Package

Performance package corresponding to Dexron VI, as used in automatic transmissions in cars (does not include viscosity index improver).

The following examples of embodiment and comparative examples were prepared.

Example of Embodiment 1

The lubricating oil composition of Example of Embodiment 1 was obtained by adding 4.0 mass % of base oil (B-2) and 10.5 mass % of additive (D-2) and 9 mass % of additive (E) to 76.5 mass % of the aforementioned base oil (A-1) and mixing well.

Examples of Embodiment 2 & 3

The lubricating oil compositions of Examples of Embodiment 2 and 3 were obtained by using the compositions shown in Table 1, otherwise in accordance with Example of Embodiment 1.

Comparative Examples 1 to 9

The lubricating oil compositions of Comparative Examples 1 to 9 were obtained by using the compositions shown in Tables 2 and 3, otherwise in accordance with Example of Embodiment 1.

Tests

The following tests were appropriately carried out in order to ascertain the characteristics and performance of the aforementioned examples of embodiment and comparative examples.

40° C. Kinematic Viscosity

The 40° C. kinematic viscosity ($mm^2/s$) was measured on the basis of JIS K2283.

Evaluation Criteria:

| | |
|---|---|
| Not more than 30.0 $mm^2/s$ | Good (○) |
| Exceeding 30.0 $mm^2/s$ | Poor (X) |

100° C. Kinematic Viscosity

The 100° C. kinematic viscosity ($mm^2/s$) was measured on the basis of JIS K2283.

Evaluation Criteria:

| | |
|---|---|
| From 6.4 to not more than 7.0 $mm^2/s$ | Good (○) |
| Below 6.4 or above 7.0 $mm^2/s$ | Poor (X) |

Viscosity Index

Calculated on the basis of JIS K2283.

Evaluation Criteria:

| | |
|---|---|
| 190 and above | Good (○) |
| Below 190 | Poor (X) |

−30° C. Brookfield Viscosity

The −30° C. low temperature viscosity (mPa·s was measured on the basis of ASTM D 2983.

Evaluation Criteria:

| | |
|---|---|
| Not more than 2,000 mPa · s | Good (○) |
| Exceeding 2,000 mPa · s | Poor (X) |

−40° C. Brookfield Viscosity

The −40° C. low temperature viscosity (mPa·s was measured on the basis of ASTM D 2983.

Evaluation Criteria:

| | |
|---|---|
| Not more than 5,900 mPa · s | Good (○) |
| Exceeding 5,900 mPa · s | Poor (X) |

NOACK Volatility Test

The test was carried out in accordance with ASTM D5800. That is to say, the rate of reduction in mass (mass %) after thermal ageing through heating for 1 hour at 200° C. was measured.

Evaluation Criteria:

| | |
|---|---|
| Not more than 10.0 mass % | Good (○) |
| Exceeding 10.0 mass % | Poor (X) |

Seal Characteristics Test

Nitrile rubber ("A727" made by NOK Ltd.) as used for oil seals was immersed in the lubricating oil compositions of the examples of embodiment and comparative examples, and the change in volume (%), change in mass (%) and change in hardness (%) after treatment for 140 hours at 140° C. were obtained.

Evaluation Criteria for Change in Volume:

| | |
|---|---|
| Not more than 10% | Good (○) |
| Exceeding 10% | Poor (X) |

Evaluation Criteria for Change in Mass:

| | |
|---|---|
| Not more than 5% | Good (○) |
| Exceeding 5% | Poor (X) |

Evaluation Criteria for Change in Hardness:

| | |
|---|---|
| −10% and above | Good (○) |
| Below −10% | Poor (X) |

KRL Shear Stability Test

On the basis of CEC-L-45-A-99, treatment was carried out for 20 hours at 60° C., and the 100° C. kinematic viscosity after the treatment was measured. The reduction (%) in the viscosity relative to before the treatment was obtained for the 100° C. kinematic viscosity.

Evaluation Criteria:

| | |
|---|---|
| Reduction in 100° C. kinematic viscosity not more than 3.0% | Good (○) |
| Reduction in 100° C. kinematic viscosity exceeding 3.0% | Poor (X) |

Results

Tables 1 to 3 show the results of the aforementioned tests.

TABLE 1

| | | Example of Embodiment 1 | Example of Embodiment 2 | Example of Embodiment 3 |
|---|---|---|---|---|
| Base oil | A-1 | 76.5 | 71.9 | 72.2 |
| | A-2 | | | |
| | A-3 | | | |
| Base oil | B-1 | | | |
| | B-2 | 4.0 | 4.0 | 4.0 |
| | B-3 | | | |
| Base oil | C-1 | | 5.0 | |
| | C-2 | | | 5.0 |
| Additive | D-1 | | | |
| | D-2 | 10.5 | 10.1 | 9.8 |
| | D-3 | | | |
| Additive | E | 9.0 | 9.0 | 9.0 |
| Viscosity index | | 196 | 198 | 193 |
| 40° C. kinematic viscosity ($mm^2/s$) | | 28.29 | 28.06 | 28.38 |
| 100° C. kinematic viscosity ($mm^2/s$) | | 6.513 | 6.508 | 6.481 |
| −30° C. BF viscosity (mPa · s) | | 1600 | 1600 | 1600 |
| −40° C. BF viscosity (mPa · s) | | 5300 | 4800 | 5000 |
| NOACK evaporation (mass %) | | 8.2 | 8 | 8 |
| Seal characteristics test | | | | |
| Volume change (%) | | | 4.6 | |
| Mass change (%) | | | 2.3 | |
| Hardness change (%) | | | −7.5 | |
| KRL shear test | | | | |
| Reduction in 100° C. kinematic viscosity (%) | | 1.8 | | |

TABLE 2

| | | Comp. Ex. 1 | Comp. Ex. 2 | Comp. Ex. 3 | Comp. Ex. 4 | Comp. Ex. 5 |
|---|---|---|---|---|---|---|
| Base oil | A-1 | | | 52.8 | 47.2 | |
| | A-2 | 77.5 | 72.6 | | 30.0 | |
| | A-3 | | | | | 76.8 |
| Base oil | B-1 | | | | | |
| | B-2 | 4.0 | 4.0 | 4.0 | 4.0 | 4.0 |
| | B-3 | | | | | |
| Base oil | C-1 | | 5.0 | 25.0 | | |
| | C-2 | | | | | |
| Additive | D-1 | | | | | |
| | D-2 | 9.5 | 9.4 | 9.2 | 9.8 | 10.2 |
| | D-3 | | | | | |
| Additive | E | 9.0 | 9.0 | 9.0 | 9.0 | 9.0 |
| Viscosity index | | 192 | 196 | 200 | 194 | 193 |
| 40° C. kinematic viscosity ($mm^2/s$) | | 28.52 | 28.14 | 27.83 | 28.38 | 28.63 |
| 100° C. kinematic viscosity ($mm^2/s$) | | 6.482 | 6.490 | 6.503 | 6.483 | 6.522 |
| −30° C. BF viscosity (mPa · s) | | 1800 | 1700 | 1500 | 1900 | |
| −40° C. BF viscosity (mPa · s) | | x 6600 | 5700 | 4500 | x 6000 | |
| NOACK evaporation (mass %) | | x 15.8 | x 15.5 | 7.1 | x 11.2 | x 16.2 |
| Seal characteristics test | | | | | | |
| Volume change (%) | | | | x 10.5 | | |
| Mass change (%) | | | | x 5.9 | | |
| Hardness change (%) | | | | x −13.5 | | |
| KRL shear test | | | | | | |
| Reduction in 100° C. kinematic viscosity (%) | | | | | | |

TABLE 3

| | | Comp. Ex. 6 | Comp. Ex. 7 | Comp. Ex. 8 | Comp. Ex. 9 |
|---|---|---|---|---|---|
| Base oil | A-1 | 70.9 | 77.6 | 76.0 | 82.3 |
| | A-2 | | | | |
| | A-3 | | | | |
| Base oil | B-1 | 9.6 | | | |
| | B-2 | | | 4.0 | 4.0 |
| | B-3 | | 2.9 | | |
| Base oil | C-1 | | | | |
| | C-2 | | | | |
| Additive | D-1 | | | 11.0 | |
| | D-2 | 10.5 | 10.5 | | |
| | D-3 | | | | 4.7 |
| Additive E | | 9.0 | 9.0 | 9.0 | 9.0 |
| Viscosity index | | x 187 | 199 | x 184 | 221 |
| 40° C. kinematic viscosity ($mm^2/s$) | | 29.35 | 28.12 | 29.51 | 25.97 |
| 100° C. kinematic viscosity ($mm^2/s$) | | 6.532 | 6.490 | 6.510 | 6.491 |
| −30° C. BF viscosity (mPa · s) | | | | | |
| −40° C. BF viscosity (mPa · s) | | | | | |
| NOACK evaporation (mass %) | | | | | |
| Seal characteristics test | | | | | |
| Volume change (%) | | | | | |
| Mass change (%) | | | | | |
| Hardness change (%) | | | | | |
| KRL shear test | | | | | |
| Reduction in 100° C. kinematic viscosity (%) | | | x 3.1 | | x 15.2 |

In Examples of Embodiment 1 to 3, good results were obtained in each case for 40° C. kinematic viscosity, 100° C. kinematic viscosity, viscosity index, −30° C.·BF viscosity, −40° C.·BF, viscosity and NOACK evaporation. In addition, good results were also obtained in the KRL shear stability test for Example of Embodiment 1. Further, Example of Embodiment 2 took Example of Embodiment 1 as a basis but added 5 mass % of ester base oil (C-1), and even better results were obtained in the aforementioned tests than for Example of Embodiment 1, and the seal characteristics were also assessed as good.

In contrast, Comparative Example 1 replaced GTL base oil (A-1) of Example of Embodiment 1 with mineral oil (A-2) in the blend and −40° C.·BF was large at 6,600 mPa·s, while the NOACK evaporation also showed a large value at 15.8 mass %. As with the aforementioned Example of Embodiment 1, it was evident that the forms using a GTL base oil had lower volatility and were superior as regards low-temperature flow characteristics.

Comparative Example 2 added ester base oil (C-1) to Comparative Example 1 and so the −40° C.·BF became 5,700 mPa·s, improving the low-temperature viscosity, but the NOACK evaporation could not be improved.

In Comparative Example 3, the content of GTL base oil was reduced to 52.8 mass % whilst 25 mass % of ester base oil was incorporated. The results obtained for 40° C. kinematic viscosity, 100° C. kinematic viscosity, viscosity index, −30° C.·BF viscosity, −40° C.·BF, viscosity and NOACK evaporation were as good as or better than for Example of Embodiment 1, but the impact on oil seals was significant and in the seal characteristics test the hardness change was −13.5%, volume change was 10.5% and mass change was 5.9%, so that the JASO standard (M315 2004) was not satisfied. Thus if a comparison is made with Example of Embodiment 2, the ester base oil can improve various characteristics, but in excess it is evident that it is detrimental to oil seal compatibility.

In Comparative Example 4, the proportion of GTL base oil was reduced and it was mixed with mineral oil (A-2), but the −40° C.·BF, viscosity became high at 6,000 mPa·s so was not appropriate. Comparative Example 5 used PAO (A-3) for superior low-temperature flow characteristics, and it was evident that the NOACK evaporation became extremely poor, which was undesirable.

In Comparative Example 6, in place of the high viscosity base oil (B-2) of Example of Embodiment 1, high viscosity base oil (B-1) was used, but the viscosity index fell to 187 and so did not satisfy the stipulation of being not less than 190. In Comparative Example 7, high viscosity base oil (B-3) was used instead of the high viscosity base oil (B-2) of Example of Embodiment 1. The amount added was also reduced and the viscosity index rose to 199, but the reduction in shear in the KRL shear stability test was 3.1%, exceeding the criterion. From these examples it can be seen that in the case of 100° C. kinematic viscosity in relation to the molecular weight of the ethylene-α-olefin copolymer of the high viscosity base oil, it is either too low as in 40 $mm^2/s$ or too high as in 2,000 $mm^2/s$, which is not desirable.

Comparative Example 8 changed the additive (D-2) (weight-average molecular weight 16,000) of Example of Embodiment 1 to additive (D-1) (weight-average molecular weight 5,200), adjusting the blended amount in consideration of the molecular weight, but the viscosity index fell substantially to 184. Also, in Comparative Example 9, additive (D-3) (weight-average molecular weight 85,000) was used, and the amount in the blend was reduced. To compensate, the amount of GTL base oil in the blend was increased, but it was evident that the KRL shear stability fell substantially.

That which is claimed is:

1. A lubricating oil composition for automatic transmissions, the lubricating oil comprising:

a low viscosity base oil at a concentration of 55% to 85% by mass, wherein the low viscosity base oil comprises a Fischer-Tropsch synthetic oil, and wherein the low viscosity base oil has a kinematic viscosity of 2 to 4 $mm^2/s$ at 100° C., a high viscosity base oil at a concentration of 1% to 10% by mass, wherein the high viscosity base oil comprises an olefin copolymer, and wherein the olefin copolymer has a kinematic viscosity of 150 to 1,000 $mm^2/s$ at 100° C., a polymethacrylate having a molecular weight of 10,000 to 50,000 by weight-average, wherein the lubricating oil composition has:

a kinematic viscosity of 6 $mm^2/s$ to 7 $mm^2/s$ at 100° C.;

a viscosity index of at least 190;

a low temperature (−40° C.) Brookfield viscosity of not more than 6,000 mPa·s;

a rate of reduction of the kinematic viscosity as measured by a KRL shear stability test of not more than 3% at 60° C. for 20 hours; and an evaporation loss of not more than 10% by mass as measured by the NOACK method for 200° C./hour.

2. The lubricating oil composition of claim 1, further comprising an ester base oil at a concentration of 1% to 20% by mass, wherein the ester base oil has a kinematic viscosity of 2 to 5 $mm^2/s$ at 100° C..

3. The lubricating oil composition of claim 1, wherein the olefin copolymer has a kinematic viscosity of 300 to 800 $mm^2/s$ at 100° C..

4. The lubricating oil composition of claim 1, wherein the polymethacrylate has a molecular weight of 15,000 to 30,000 by weight average.

5. The lubricating oil composition of claim 1, wherein the olefin copolymer comprises an ethylene-α-olefin.

* * * * *